US011262076B2

(12) United States Patent
Lee et al.

(10) Patent No.: US 11,262,076 B2
(45) Date of Patent: Mar. 1, 2022

(54) COMBUSTOR HAVING COUPLING STRUCTURE FOR NOZZLE PLATE AND OUTER CAP, AND GAS TURBINE INCLUDING THE SAME

(71) Applicant: DOOSAN HEAVY INDUSTRIES & CONSTRUCTION CO., LTD., Changwon-si (KR)

(72) Inventors: Seung Min Lee, Suwon-si (KR); Dong Hun Kim, Yongin-si (KR); Jong Hwa Lee, Seongnam-si (KR)

( * ) Notice: Subject to any disclaimer, the term of this patent is extended or adjusted under 35 U.S.C. 154(b) by 222 days.

(21) Appl. No.: 16/202,194

(22) Filed: Nov. 28, 2018

(65) Prior Publication Data

US 2019/0249603 A1 Aug. 15, 2019

(30) Foreign Application Priority Data

Feb. 9, 2018 (KR) ..... 10-2018-0016129

(51) Int. Cl.
*F23R 3/60* (2006.01)
*F23R 3/28* (2006.01)

(52) U.S. Cl.
CPC ..... *F23R 3/60* (2013.01); *F23R 3/283* (2013.01); *F05D 2230/60* (2013.01); (Continued)

(58) Field of Classification Search
CPC .. F23R 3/60; F23R 3/283; F23R 2900/00017; F23R 2900/00005; F05D 2230/64; (Continued)

(56) References Cited

U.S. PATENT DOCUMENTS 5,758,503 A * 6/1998 DuBell ..... F23R 3/002 60/752
6,334,298 B1 * 1/2002 Aicholtz ..... F23R 3/283 60/750

(Continued)

FOREIGN PATENT DOCUMENTS

JP 2003508888 A 3/2003
JP 2012207565 A 10/2012

OTHER PUBLICATIONS

A Korean Office Action dated Jul. 1, 2019 in connection with Korean Patent Application No. 10-2018-0016129 which corresponds to the above-referenced U.S. application.

*Primary Examiner* — Stephanie Sebasco Cheng
(74) *Attorney, Agent, or Firm* — Harvest IP Law, LLP

(57) ABSTRACT

A combustor of a gas turbine includes a nozzle plate to accommodate an arrangement of fuel injection nozzles; an outer cap coupled with the nozzle plate while surrounding an outer circumferential periphery of the nozzle plate; a plurality of first protrusions radially protruding from the outer cap toward a center of the outer cap, the first protrusions arranged in a circumferential direction of the outer cap; and a plurality of first guide holes arranged at the outer circumferential periphery of the nozzle plate in a circumferential direction, to be respectively engaged with the first protrusions. Each first guide hole communicates with a linear recess and with a first fixing recess disposed at an end of the linear recess. The combustor, and a gas turbine including the combustor, evenly distribute stress to the nozzle plate and the outer cap, while minimizing thermal deformation of combustor components in a high-temperature operating environment.

7 Claims, 9 Drawing Sheets

(52) U.S. Cl.
CPC .... *F05D 2230/642* (2013.01); *F05D 2240/90* (2013.01); *F05D 2260/30* (2013.01); *F23R 2900/00005* (2013.01); *F23R 2900/00017* (2013.01)

(58) Field of Classification Search
CPC ..... F05D 2230/642; F05D 2240/90; F05D 2260/30; F05D 2260/33; F05D 2230/51; F05D 2230/644; F05D 2260/36; F05D 2260/37
See application file for complete search history.

(56) References Cited

U.S. PATENT DOCUMENTS

| | | | | |
|---|---|---|---|---|
| 7,806,663 | B2 * | 10/2010 | Buschmann | F16L 41/001 416/244 A |
| 10,295,189 | B2 * | 5/2019 | Pidcock | F23R 3/50 |
| 2009/0188255 | A1 | 7/2009 | Green et al. | |

* cited by examiner

【FIG. 1】

Related Art

【FIG. 4A】
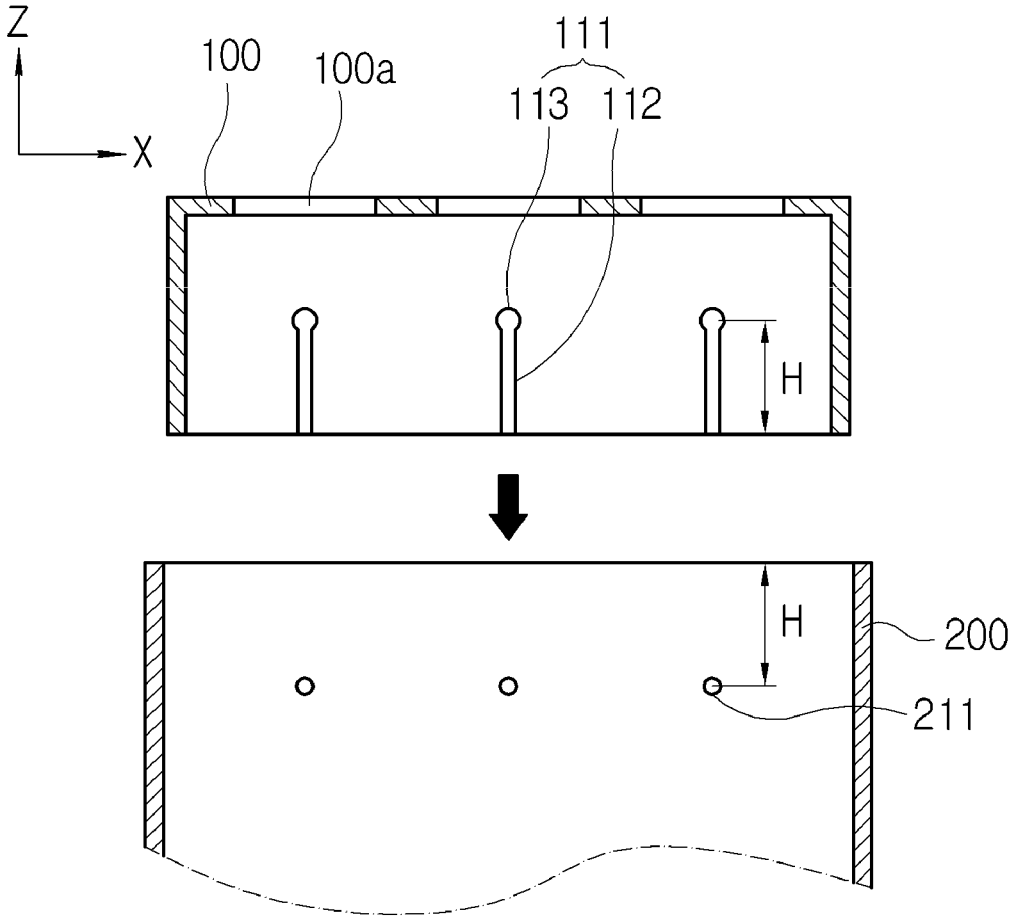

【FIG. 4B】
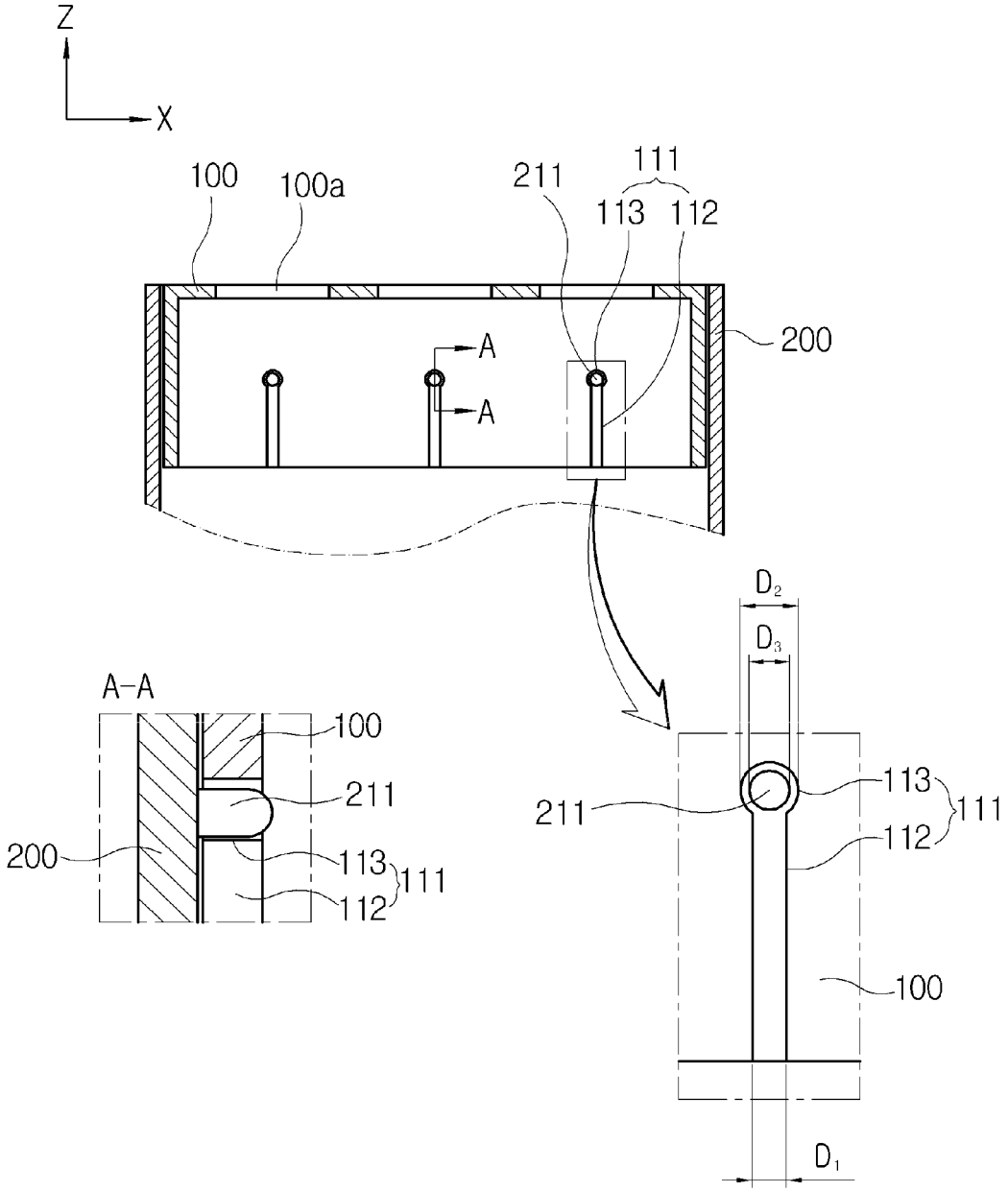

【FIG. 5A】
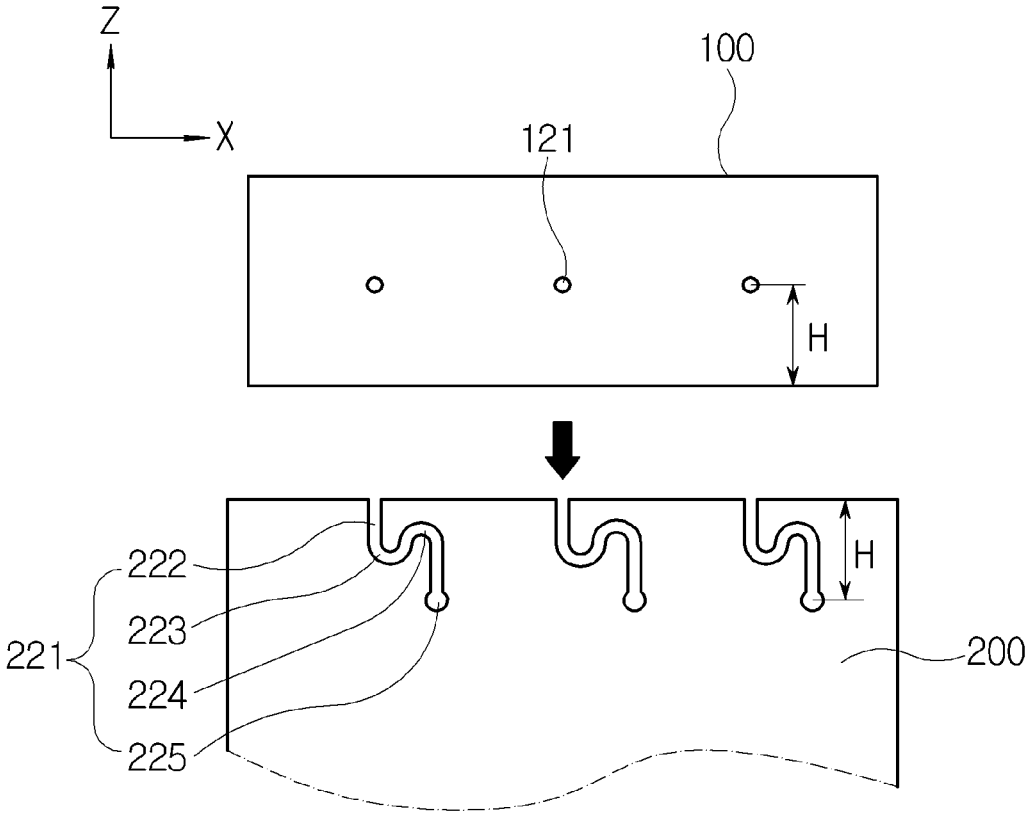

【FIG. 5B】
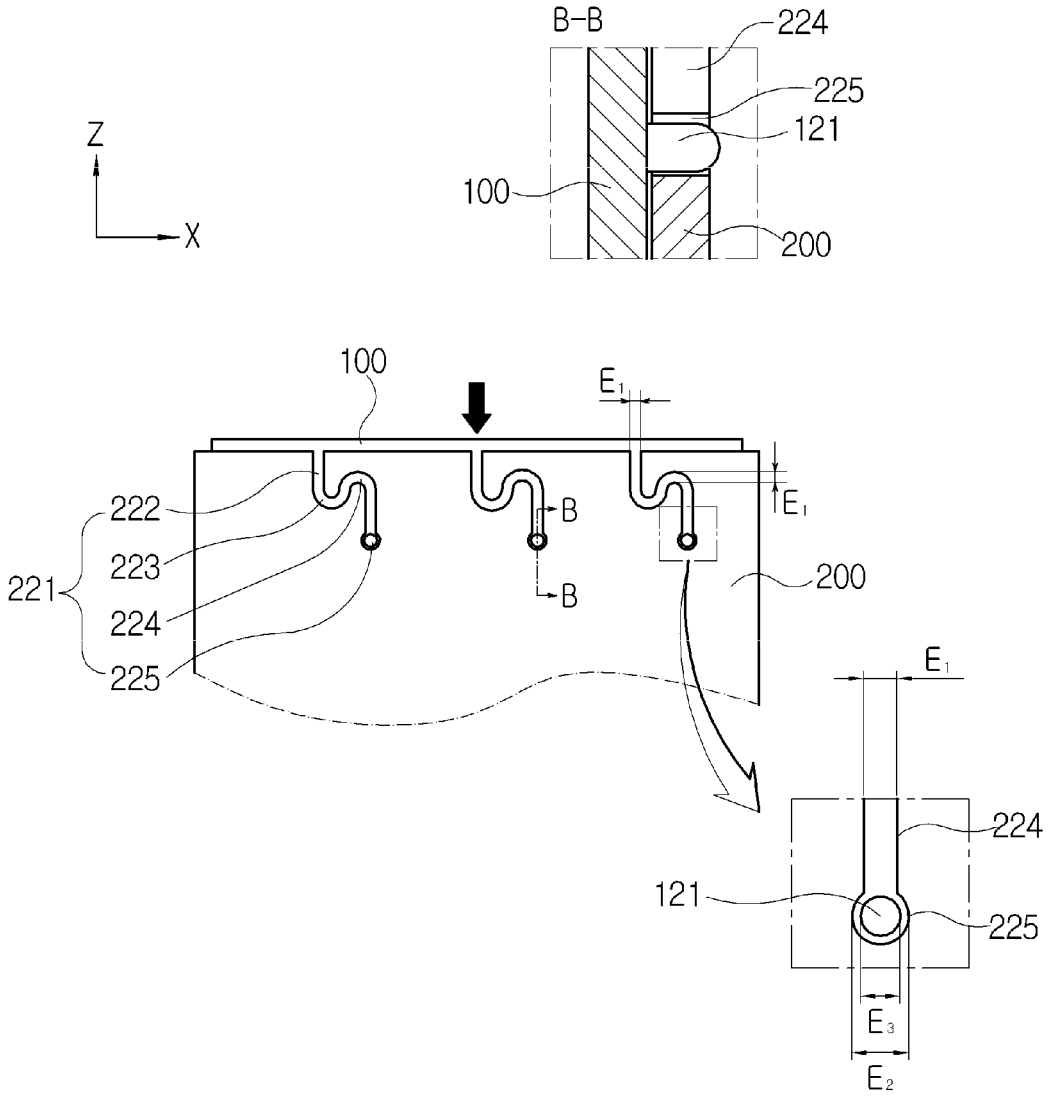

【FIG. 6A】
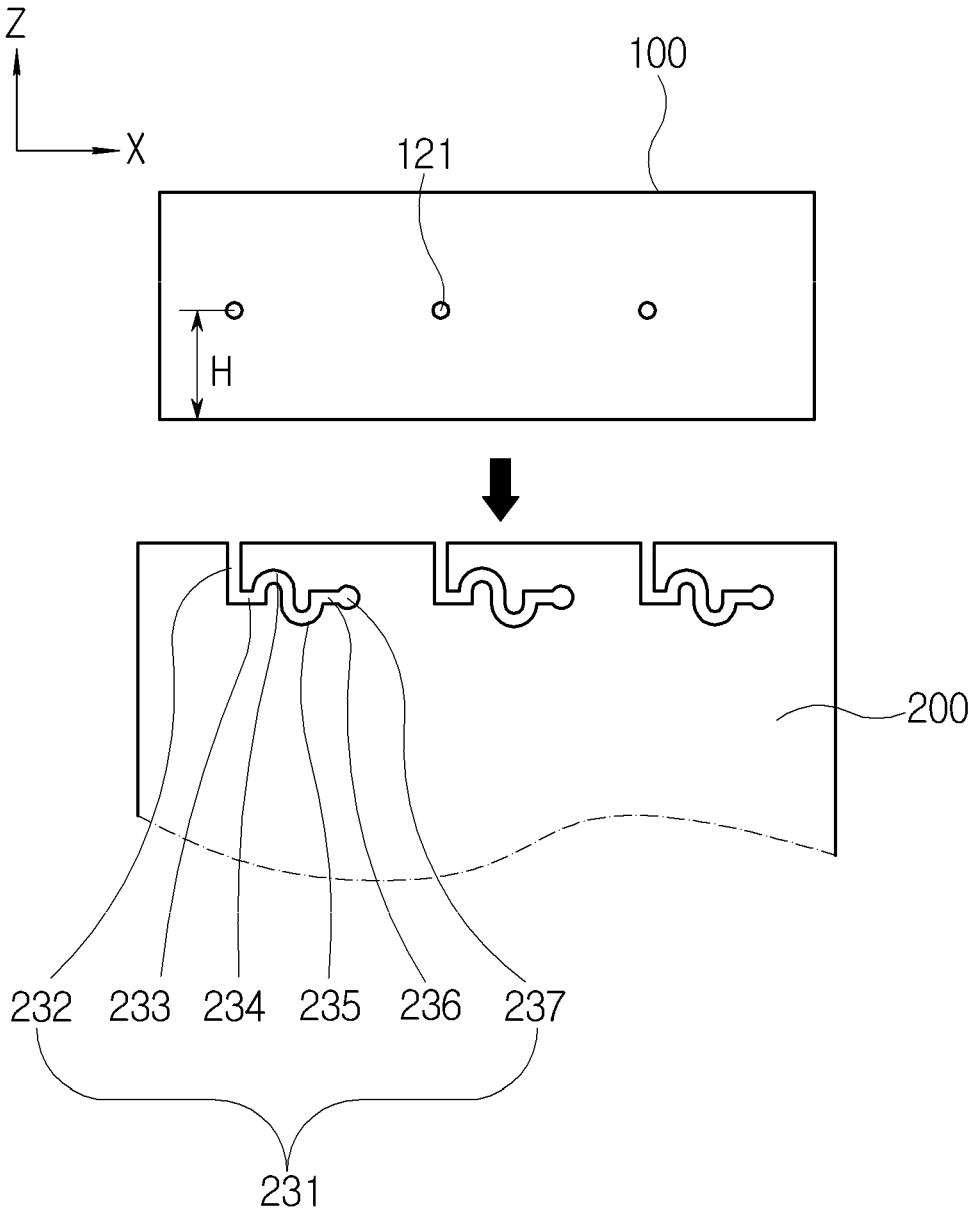

【FIG. 6B】
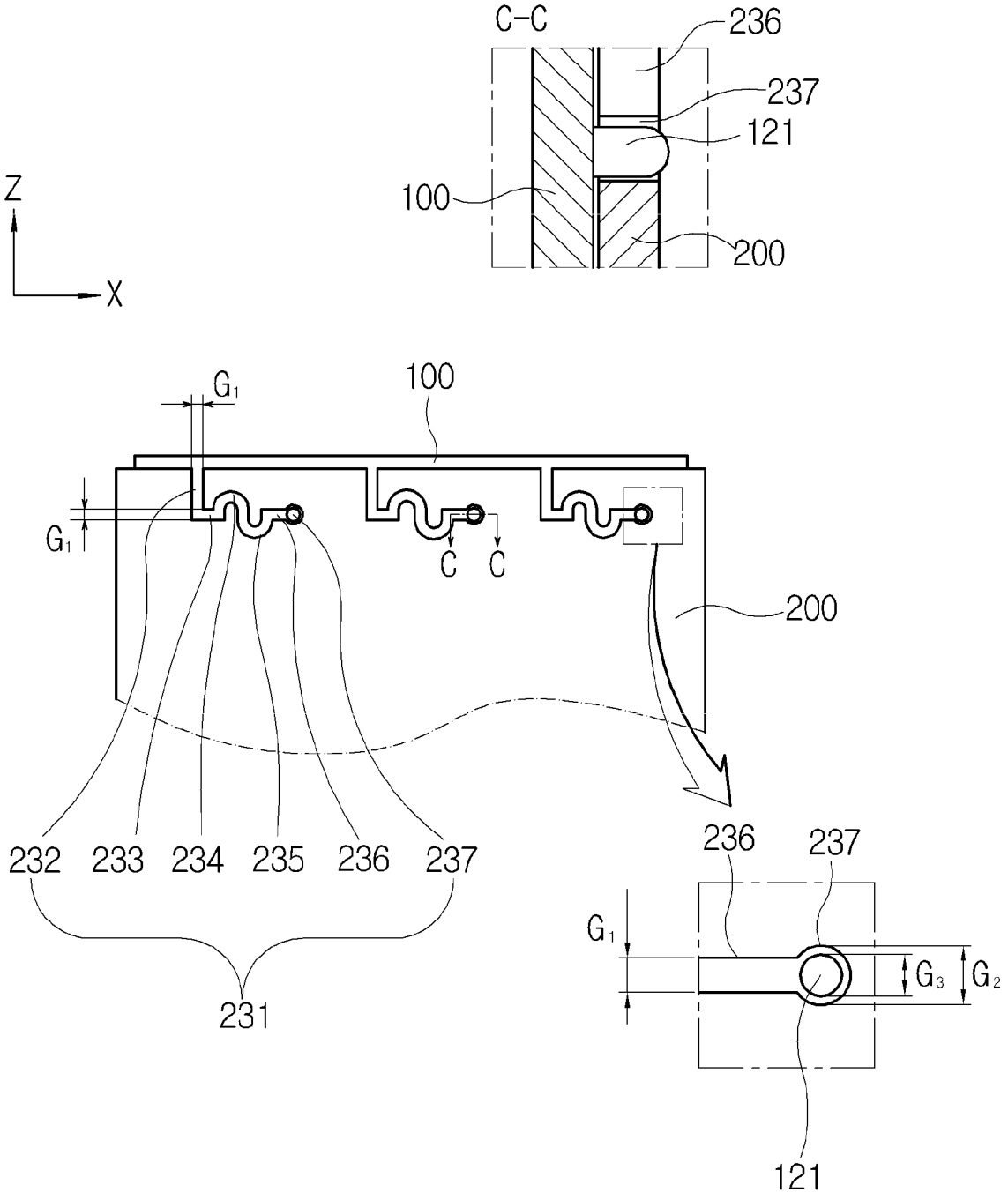

COMBUSTOR HAVING COUPLING STRUCTURE FOR NOZZLE PLATE AND OUTER CAP, AND GAS TURBINE INCLUDING THE SAME

CROSS REFERENCE TO RELATED APPLICATIONS

The present application claims priority to Korean Patent Application No. 10-2018-0016129, filed Feb. 9, 2018, the entire contents of which is incorporated herein for all purposes by this reference.

BACKGROUND OF THE INVENTION

1. Field of the Invention

The present disclosure relates to an improved combustor and a gas turbine including the combustor. More particularly, the present disclosure relates to a combustor having an improved structure for connecting a nozzle plate and an outer cap of the combustor so that stress is evenly distributed among components of the combustor and for securing a thermal expansion space so that thermal expansion deformation of the combustor components is minimized in a high temperature environment.

2. Description of the Background Art

In general, a turbine is a power generating apparatus that transforms thermal energy of a fluid such as a gas or a steam to mechanical energy such as a rotational force. Such a turbine includes a rotor provided with a plurality of rotor blades (buckets) rotated on the axis by the fluid and a casing configured to encase the rotor and provided with a plurality of stator blades (diaphragms).

A gas turbine is composed of a compressor section, a combustor section, and a turbine section. The external air is taken in and compressed by the rotation of the compressor section, and the resulting compressed air is sent to the combustor section in which the compressed air and a fuel are mixed and burned. A high-temperature high-pressure gas is generated in the combustor section and is delivered to the turbine section. The high-temperature high-pressure gas rotates the rotor while passing through the turbine section.

FIG. 1 illustrates a combustor nozzle plate 102 and an outer cap 103 of a typical combustor for use in a gas turbine as described above.

The nozzle plate 102 has a plurality of mounting holes 102*a* in which a plurality of fuel injection nozzles are respectively mounted. The outer cap 103 has a ring shape and surrounds the outer circumference of the nozzle plate 102. The outer cap 103 defines an interior space of a combustor.

Conventionally, when connecting the nozzle plate 102 and the outer cap 103, the nozzle plate 102 is first fitted in the outer cap 103 such that the outer circumferential surface of the nozzle plate 102 is in contact with the inner circumferential surface of the outer cap 103, and then a plurality of contact points S disposed along the circumferential direction are spot-welded. However, in the case of using such a spot-welding method, there is a problem that stress is more concentrated on spot welded portions than the other portions.

In particular, a combustor actually operates in a high-temperature environment and thus metal components experience thermal expansion due to the high-temperature environment. In this case, the thermal expansion is restricted at the spot-welded portions so that thermal expansion deformation intensely occurs at the spot-welded portions.

SUMMARY OF THE DISCLOSURE

The present disclosure has been made in order to solve the problems occurring in the related art and an objective of the present disclosure is to provide a combustor having an improved coupling structure that couples a nozzle plate with an outer cap of the combustor in a manner of evenly distributing stress among components of the combustor, secures room to accommodate thermal expansion of the combustor components, and minimizes thermal deformation of the components of a combustor in a high-temperature operating environment. Another objective of the present disclosure is to provide a gas turbine including the combustor.

To achieve the above objectives, the present disclosure provides a combustor of a gas turbine. The combustor may include a nozzle plate to accommodate an arrangement of fuel injection nozzles; an outer cap coupled with the nozzle plate while surrounding an outer circumferential periphery of the nozzle plate; a plurality of first protrusions radially protruding from the outer cap toward a center of the outer cap, the first protrusions arranged in a circumferential direction of the outer cap; and a plurality of first guide holes arranged at the outer circumferential periphery of the nozzle plate in a circumferential direction and configured to be respectively engaged with the first protrusions.

Each first guide hole may communicate with a linear recess extending in a first direction in which the nozzle plate is inserted into the outer cap with a first fixing recess disposed at an end of the linear recess. The linear recess may have a width that is not larger than a width of a corresponding first protrusion of the plurality of first protrusions, the width of the linear recess enabling the corresponding first protrusion to be press-fitted into and press-moved through the linear recess. Each first guide hole may communicate with a first fixing recess disposed at an end of the linear recess. The first fixing recess may have a width larger than a width of a corresponding first protrusion of the plurality of first protrusions, to secure room to accommodate thermal expansion of the corresponding first protrusion and thermal deformation of the first fixing recess.

Each first protrusion may have a rounded circumference to facilitate movement of the first protrusions through the first guide holes.

The plurality of first protrusions may be provided on an inner circumferential surface of the outer cap and may be arranged in the circumferential direction at a predetermined interval, and the plurality of first guide holes may be arranged along the outer circumferential periphery at positions respectively corresponding to the plurality of first protrusions.

In one embodiment of the present disclosure, the combustor may include a nozzle plate to accommodate an arrangement of fuel injection nozzles; an outer cap coupled with the nozzle plate while surrounding an outer circumferential periphery of the nozzle plate; a plurality of second protrusions radially protruding outward from the nozzle plate, the second protrusions arranged in a circumferential direction of the nozzle plate; and a plurality of second guide holes arranged at an inner circumferential periphery of the outer cap in a circumferential direction and configured to be respectively engaged with the second protrusions.

Each second guide hole may communicate with a linear recess extending in a first direction in which the nozzle plate is inserted into the outer cap, and the linear recess may have a width that is not larger than a width of a corresponding second protrusion of the plurality of first protrusions, the width of the linear recess enabling the corresponding second protrusion to be press-fitted into and press-moved through the linear recess. Each second guide hole may also communicate with a first recess curve concave-curved in a downward direction of the first direction to prevent the corresponding second protrusion inserted into the linear recess from escaping from the second guide hole and with a second recess curve concave-curved in an upward direction of the first direction to prevent the corresponding second protrusion inserted into the first recess curve from escaping from the second guide hole. Here, the first recess curve and the second recess curve may each have a width that is not larger than the corresponding second protrusion, the width of the first and second recess curves enabling the corresponding second protrusion to be press-fitted into and press-moved through the first and second recess curves. Additionally, the second guide hole may communicate with a second fixing recess disposed at an end of the second recess curve, and the second fixing recess may have a larger width than the corresponding second protrusion so as to secure room to accommodate thermal expansion of the corresponding second protrusion and thermal deformation of the second fixing recess.

Moreover, the second guide hole may also communicate with each of: a first linear recess extending, from an axial end of the outer cap, in a first direction in which the nozzle plate is inserted into the outer cap; and a second linear recess extending from an end of the first linear recess in a second direction which is a circumferential direction of the outer cap. Here, the first and second linear recesses may each have a width that is not larger than a width of corresponding second protrusion of the plurality of second protrusions, the widths of the first and second linear recesses enabling the corresponding second protrusion to be press-fitted into and press-moved through the first and second linear recesses.

The second guide hole may further communicate with a first recess stop concave-curved in a downward direction of the first direction to prevent the corresponding second protrusion passing through the second linear recess from escaping from the second linear recess and with a second recess stop concave-curved in an upward direction of the first direction to prevent the corresponding second protrusion passing through the first recess stop from escaping from the first recess stop. Here, the first recess stop and the second recess stop may each have a width that is not larger than the width of the second protrusion, the widths of the first and second recess stops enabling the corresponding second protrusion to be press-fitted into and press-moved through the first and second recess stops.

The second guide hole may further communicate with a third linear recess extending from an end of the second recess stop in a second direction that is a circumferential direction of the outer cap and with a second fixing recess disposed at an end of the third linear recess. Here, the second fixing recess may have a width larger than the width of the corresponding second protrusion to secure room to accommodate thermal expansion of the corresponding second protrusion and thermal deformation of the second fixing recess.

In another aspect of the present invention, there is provided a gas turbine including a casing; a compressor section disposed inside the casing and configured to compress air externally introduced to produce compressed air; the combustor section disposed inside the casing and configured to burn the compressed air to produce a combustion gas; a turbine section disposed inside the casing and configured to generate power using the combustion gas; and a diffuser disposed inside the casing and configured to discharge air out of the turbine section. The combustor section may include a combustor consists with any of the above-described combustors According to the present disclosure, the nozzle plate and the outer cap of the combustor are coupled in a press-fitted manner in which the protrusions are fitted into the guide holes. This coupling manner has an advantage over conventional spot welding in terms of alleviating stress concentration at positions where parts of a combustor are coupled with each other.

In addition, in order to solve the problem of thermal deformation that is likely to occur in spot-welded portions between the nozzle plate and the outer cap of a conventional combustor in a high-temperature operating environment, according to the present disclosure, the coupling between the nozzle plate and the outer cap is changed to a fitted manner from a spot-welded manner, and the protrusions are fitted into the guide holes with a predetermined clearance to provide room for thermal expansion of the combustor's components. Therefore, it is possible to minimize damage to components of the combustor attributable to thermal expansion deformation.

BRIEF DESCRIPTION OF THE DRAWINGS

FIG. 4A is a cross-sectional view of a coupling structure for coupling a nozzle plate and an outer cap of a combustor according to a first embodiment of the present disclosure;

FIG. 4B is a cross-sectional view of a coupled state per the first embodiment of FIG. 4A;

FIG. 5A is a cross-sectional view of a coupling structure for coupling a nozzle plate and an outer cap of a combustor according to a second embodiment of the present disclosure;

FIG. 5B is a cross-sectional view of a coupled state per the second embodiment of FIG. 5A;

FIG. 6A is a cross-sectional view of a coupling structure for coupling a nozzle plate and an outer cap of a combustor according to a third embodiment of the present disclosure; and FIG. 6B is a cross-sectional view of a coupled state per the third embodiment of FIG. 6A.

DETAILED DESCRIPTION OF THE DISCLOSURE

Hereinafter, preferred embodiments of a combustor and a gas turbine including the same according to the present disclosure will be described with reference to the accompanying drawings.

Prior to describing the preferred embodiments of the present invention, the overall construction of a gas turbine will be briefly described with reference to the accompanying drawings.

Figure 1:
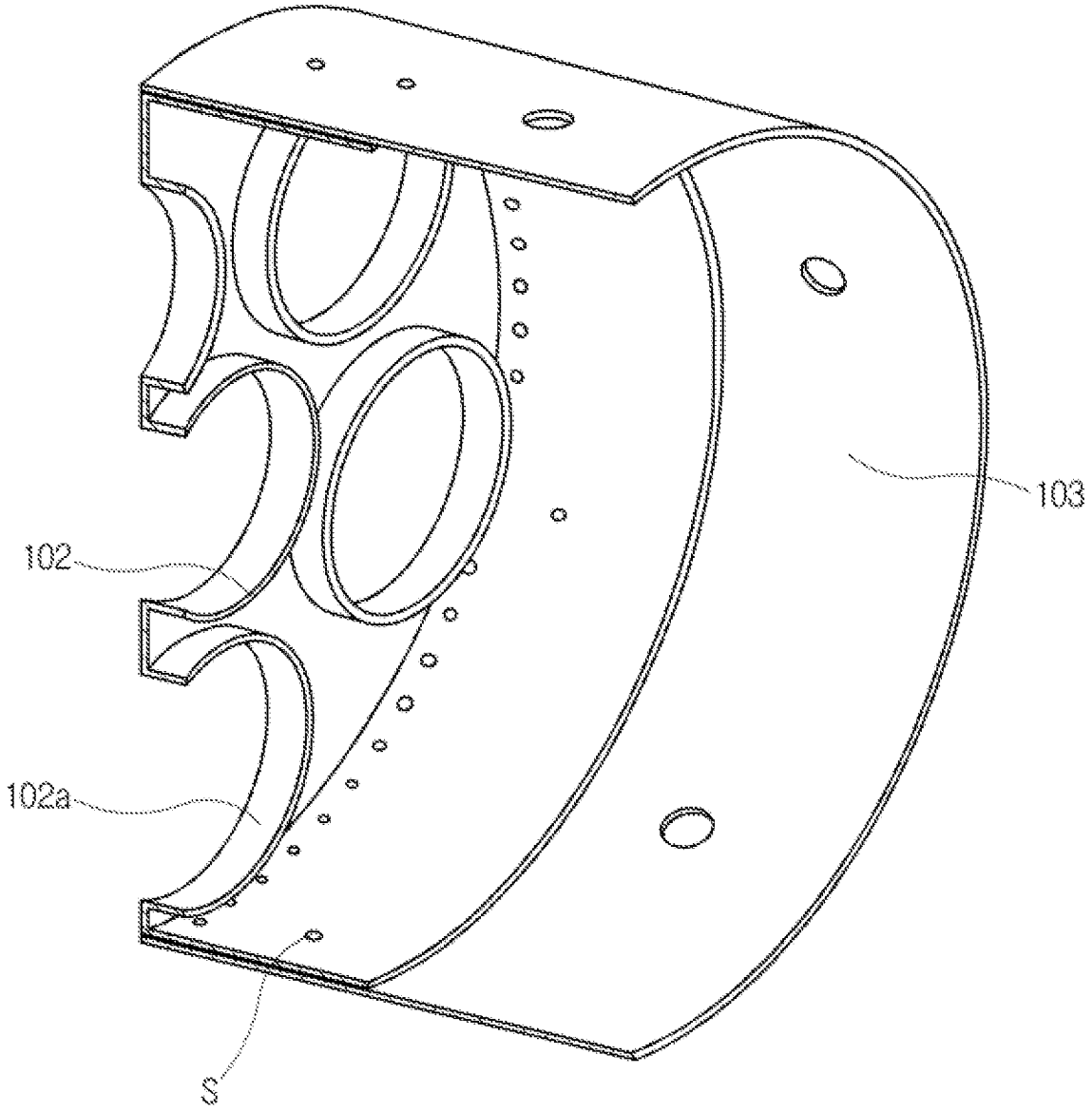
FIG. 1 is a perspective view of a portion of a nozzle plate and an outer cap of a contemporary combustor.
Figure 2:
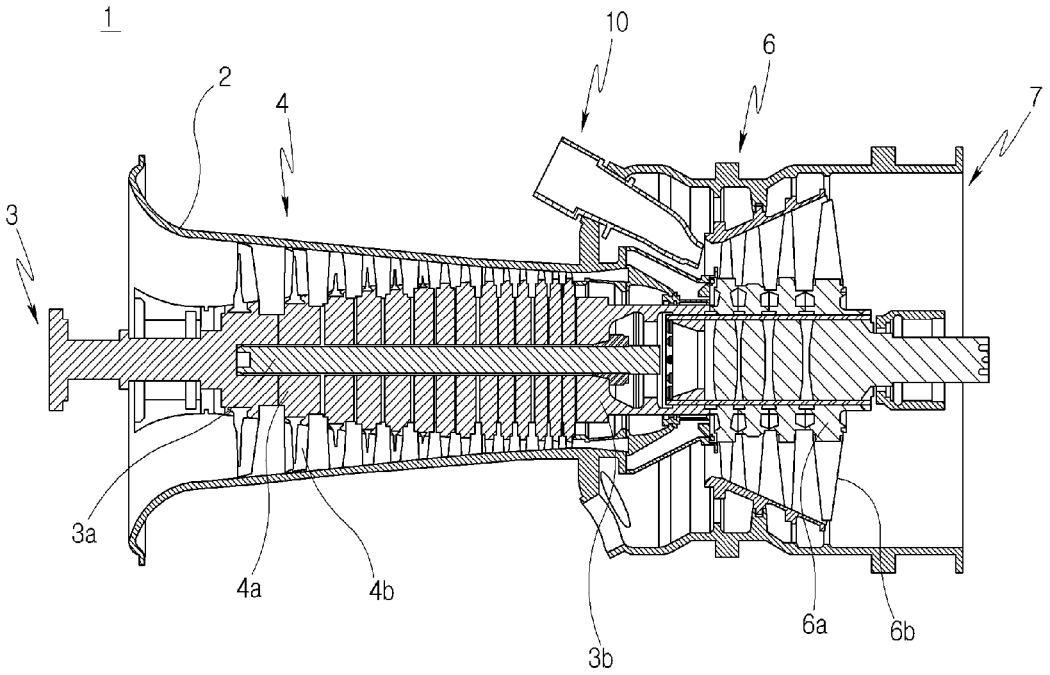
FIG. 2 is a cross-sectional view illustrating the structure of a gas turbine in which may be applied a combustor according to the present disclosure.

Referring to FIG. 2, a gas turbine 1 includes a casing 2 for defining an external form of the gas turbine, a compressor section 4 for compressing air to produce compressed air, a combustor section 10 for burning a fuel-air mixture to produce a combustion gas, a turbine section 6 for generating electric power using the combustion gas, a diffuser 7 for discharging exhaust gas, and a rotor 3 for connecting the compressor section 4 and the turbine section 6 to transfer a rotational force.

External air is introduced into the compressor section disposed at an upstream side of the gas turbine and is then compressed through adiabatic compression in a thermodynamic sense. The compressed air flows into the combustor section and then mixes with a fuel. The air-fuel mixture undergoes constant pressure combustion to generate a combustion gas. The combustion gas flows into the turbine section that is a downstream part of the gas turbine.

In terms of an air flow direction, a compressor section 4 is disposed at the front side (upstream side) of the casing 10, and a turbine section 6 is disposed at the rear side (downstream side) of the casing 10.

A torque tube 3*b* for transmitting torque generated by the turbine section 6 to the compressor section 4 is provided between the compressor section 4 and the turbine section 6.

The compressor section 4 has a plurality of (for example, fourteen) compressor rotor disks 4*a*, and the compressor disks 4*a* are fastened by a tie rod 3*a* so as not to be separated from each other in an axial direction of the tie rod 3*a*.

The compressor rotor disks 4*a* are arranged in the axial direction in a state in which the tie rod 3*a* extends to pass through the centers of the compressor rotor disks 4*a*. A flange (not illustrated) is mounted to protrude in the axial direction and to be positioned near the outer circumferential periphery of the corresponding compressor rotor disk 4*a*. The flanges are locked in rotation with respect to the adjacent compressor rotor disks 4*a*.

A plurality of blades 4*b* (also referred to as buckets) are radially coupled to the outer circumferential surface of the compressor rotor disk 4*a*. Each of the blades 4*b* has a root member (not illustrated) having, for example, a dovetail shape. The root member is inserted into a corresponding slot formed in the outer circumferential surface of the compressor rotor disk 4*a*. In this way, the blades 4*b* are coupled to the compressor rotor disk 4*a*.

The dove tail is of either a tangential entry type or an axial entry type. Choice of the tangential entry type or the axial entry type is determined depending on the structure of any given gas turbine. In some cases, the compressor blades 4*b* are coupled to the compressor rotor disk 4*a* in a coupling manner other than the dovetail coupling.

On the other hand, a plurality of vanes (not illustrated, also referred to as nozzles) that are reference positions of relative rotation of the compressor blades 4*b* are mounted via diaphragms (not illustrated) on the inner circumferential surface of the compressor section 4 of the casing 2.

The tie rod 3*a* extends through the centers of the plurality of compressor rotor disks 4*a*, in which one end of the tie rod 3*a* is coupled to the inside surface of the most upstream rotor disk 4*a* and the other end is fixed to the torque tube 3*b*.

The shape of the tie rod 3*a* varies according to the type of gas turbine. Therefore, it should be noted that the shape of the tie rod 3*a* is not limited to the example illustrated in the drawings.

For example, a single tie rod 3*a* extends through the central holes of a plurality of rotor disks. Alternatively, a plurality of tie rods extending in parallel with each other may be arranged in a circumferential direction, or a complex type using both the single-rod type and the multi-rod type may be used.

Although not illustrated in the drawings, the compressor of the gas turbine is provided with vanes serving as guide vanes at a downstream position from a diffuser, to control the inflow angle of the compressed fluid entering the combustor such that the actual inflow angle matches the designed inflow angle. An assembly of the vanes disposed downstream from the diffuser is referred to as a deswirler.

The combustor 10 mixes the compressed air with a fuel and burns the air-fuel mixture to produce a high-temperature high-pressure combustion gas with a high amount of energy. The combustion process is performed under constant pressure, and the temperature of the combustion gas is increased to critical heat-resistant temperatures of the components of the combustor 10 and the turbine section 6.

The combustion system of the gas turbine includes a plurality of combustors 10 received in respective cells of a casing 2.

The structure of the combustor 10 will be described in more detail with reference to FIG. 3.

In general, in the turbine section 6, the high-temperature high-pressure combustion gas delivered from the combustion section 6 expands, thereby giving an impulse force to or causing a reaction force of the rotor blades of the turbine section 6. That is, the thermal energy of the combustion gas is transformed into mechanical energy.

A portion of the mechanical energy generated is the turbine section 6 is transferred to the compressor section 4 so as to be used as energy required to compress air and the remainder is used as energy required to drive an electric generator to produce electric power.

In the casing of the turbine section 6, stator vanes and rotor blades are alternately arranged. The combustion gas drives the turbine rotor blades, which in turn rotate and drive the turbine output shaft to which an electric generator (not shown) is connected.

To this end, the turbine section 6 is composed of a plurality of turbine rotor disks. Each turbine rotor disk 6*a* has substantially the same shape as the compressor rotor disk 4*a*.

Like the rotor of the compressor section, each turbine rotor disk 6*a* is combined with an adjacent turbine rotor disk 6*a* with a flange (not illustrated) interposed therebetween, and a plurality of turbine blades 6*b* (also referred to as buckets) are radially arranged along the outer circumferential surface of the turbine rotor disk 6*a*. Each of the turbine blades 6*a* is also coupled to the turbine rotor disk in a dovetail coupling manner.

Here, multiple vanes (not illustrated, also referred to as nozzles) that are reference positions of relative rotation of the turbine blades 6*b* are mounted via diaphragms (not illustrated) on the inner circumferential surface of the casing 2 of the compressor section 6.

In the gas turbine having the structure described above, the intake air is compressed in the compressor section 4, then burned in the combustor 10, then injected into to the turbine section 6 to be used to drive an electric generator for generation of electric power, and finally discharged into the atmosphere via the diffuser 7.

Here, the torque tubes 3*b*, the compressor rotor disks 4*a*, the compressor blades 4*b*, the turbine rotor disks 6*a*, the turbine blades 6*b*, the tie rods 3*b*, and the like are rotary elements and are collectively called a rotor 3 or a rotating body. Meanwhile, the casing 2, the vanes (not illustrated), the diaphragms (not illustrated), and the like are stationary elements and are collectively referred to as a stator or a fixed body.

The overall structure of one typical gas turbine has been described above. Hereinafter, the present invention applicable to a gas turbine will be described.

Figure 3:
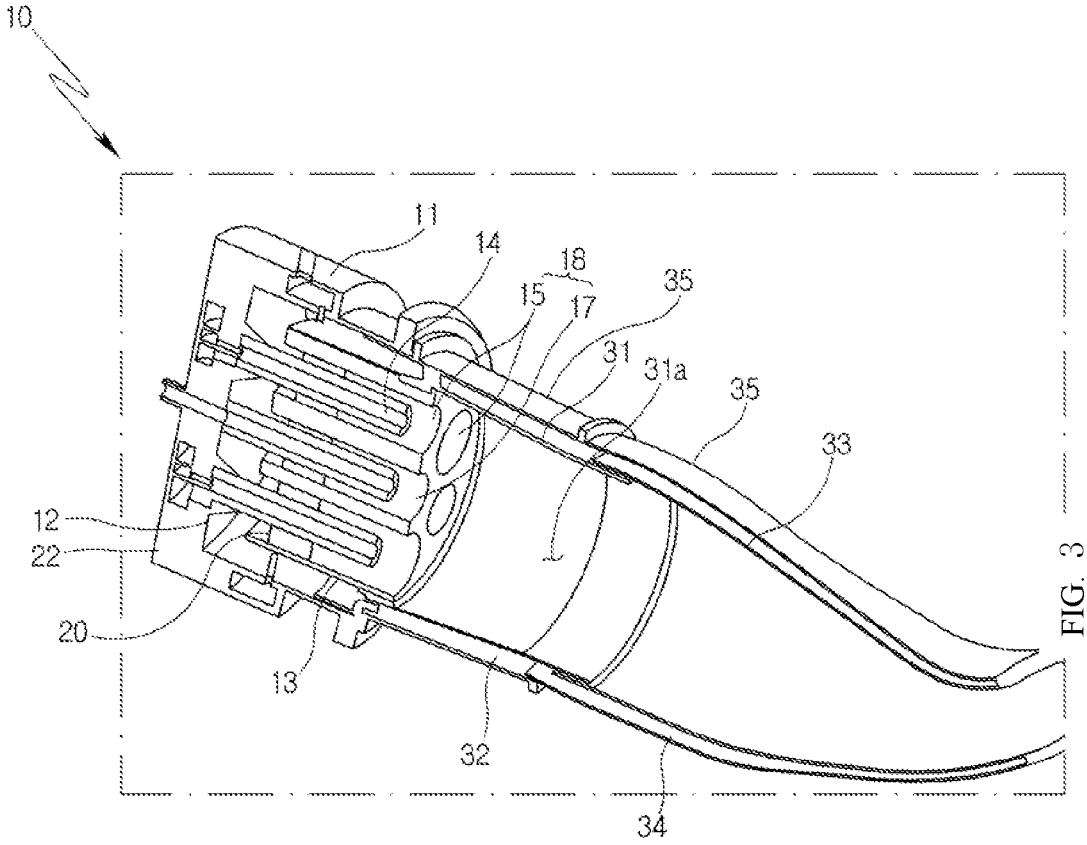
FIG. 3 Related Art
FIG. 3 is a cutaway perspective view illustrating the structure of a combustor of a gas turbine.

FIG. 3 illustrates a combustor cut along a longitudinal direction. The combustor 10 includes fuel injection nozzles 15 and 17, a burner casing 11 surrounding the fuel injection nozzles 15 and 17, a liner 31 defining a combustion chamber 31*a*, a flow sleeve 35 surrounding the liner 31 to form an annular space, a transition piece 33 serving as a connection member between the combustor 10 and the turbine 6, and a flow sleeve 35 surrounding the transition piece 33.

The liner 31 defines the combustion chamber 31*a* in which a fuel sprayed from the fuel injection nozzle 15 and 17 is mixed with the compressed air and burned. The liner 31 can be cooled by compressed air that is introduced into a compressed air flow path that is the annulus space provided between the liner 31 and the flow sleeve 35. The fuel injection nozzles 15 and 17 are connected to a front end (upstream end) of the liner.

The transition piece 33 is connected to a rear end (downstream end) of the combustor liner 31 to deliver the combustion gas, produced in the combustion chamber when the fuel-air mixture is ignited by a spark igniter plug, to the turbine. To prevent the liner 31 and the transition piece 33 from being damaged by heat of the combustion gas, the liner 31 and the transition piece 33 are cooled by the compressed air introduced into the annulus space (hereinafter referred to as compressed air flow channels 32 and 34) defined by the flow sleeve 35 surrounding the liner 31 and the transition piece 33.

Each of a plurality of fuel nozzles 18 is surrounded by a burner casing 11 functioning as a housing and is connected to the liner 31. A solid cylindrical member with a plurality of holes is provided at the front end of the liner 31 to interface between the fuel nozzles 18 and the liner 31. This solid cylindrical member is a nozzle tube 13 having the plurality of fuel nozzles 18. The holes formed in the nozzle tube 13 respectively serve as the fuel nozzles 18. The fuel nozzles 18 include a central nozzle 17 and a plurality of peripheral nozzles 15 disposed to surround the central nozzle 17.

Each of the fuel nozzles 18 is a cylindrical hole and surrounds a central body 14 extending in a front-rear direction of the combustor. A first end of the central body 14 is connected to a fuel nozzle base 12 to receive fuel from the outside. The fuel is injected into the liner through a fuel injection orifice formed in the central body 14 or a swirling vane 20 (called a swirler) disposed around the central body 14 and is then mixed with the compressed air. The position and shape of the fuel nozzle through which fuel is fed into the combustion chamber are not limited to the examples shown in FIG. 3. It should be noted that the drawings are presented only for illustrative purposes.

The nozzle base 12 is coupled to an end cover 22, and the end cover 22 includes a component for at least partially receiving the fuel.

First Embodiment

FIGS. 4A and 4B illustrate a coupling structure for coupling a nozzle plate 100 and an outer cap 200 of a combustor 10 according to a first embodiment of the present disclosure, with FIG. 4B showing the coupled state of FIG. 4A.

Referring to FIGS. 4A and 4B, the combustor 10 of the first embodiment includes the nozzle plate 100, the outer cap 200, first protrusions 211, and first guide holes 111.

The nozzle plate 100 is a combustor component made from a heat-resistant metal and includes one end in which a plurality of nozzle fitting holes 100*a* are arranged to respectively receive the corresponding plurality of fuel injection nozzles 18 (FIG. 3) for injecting fuel into the combustion chamber. Thus, the nozzle plate 100 accommodates an arrangement of the fuel injection nozzles 18.

The outer cap 200 has a predetermined diameter to surround, and fit tightly with respect to, the outer circumferential surface of the nozzle plate 100. The outer cap 200 is a combustor component made from a heat-resistant metal and is coupled with the nozzle plate 100. In the coupled state, the outer cap 200 surrounds the fuel injection nozzles 18 mounted in the nozzle plate 100.

The first protrusions 211 protrude inward from the inside surface of the outer cap 200 and are arranged at intervals in a circumferential direction.

The first guide holes 111 are formed to be recessed from the outer peripheral surface of the nozzle plate 100 and arranged at intervals in a circumferential direction in such a manner that the first protrusions 211 are respectively engaged with the first guide holes 111.

Each of the first guide holes 111 is formed of a linear recess 112 and a first fixing recess 113. Thus, each first guide hole 111 communicates with the linear recess 112 and with the first fixing recess 113.

The linear recess 112 extends in a first direction Z (the axial direction of the combustor 10) in which the nozzle plate 100 is inserted into the inside of the outer cap 200 when the nozzle plate 100 is coupled with the outer cap 200. The linear recesses 112 have a positioning function when the nozzle plate 100 is inserted into the inside of the outer cap 200, thereby enabling stable coupling between the nozzle plate 100 and the outer cap 200.

The linear recess 112 has a width D1 which is smaller than or equal to (i.e., not larger than) a width D3 of the first protrusion 211 so that the first protrusion 211 can be press-fitted into and press-moved through the linear recess 112 by a distance H to reach the first fixing recess 113 when the first protrusion 211 is engaged with the first guide hole 111. After the first protrusions 211 are inserted into and moved through the respective first linear recesses 112 to be finally engaged with the respective first fixing recesses 113, the nozzle plate 100 cannot be easily separated from the outer cap 200. This is a press-fitted coupling manner. However, the present disclosure is not limited to this press-fitted coupling.

The first fixing hole 113 is provided at an end of the linear recess 112. The first protrusion 211 is first inserted into and moved through the linear recess 112 and is then retained in the first fixing recess 113.

The first fixing recess 113 has a width D2 larger than the width D3 of the first protrusion 211 so as to secure room to accommodate the thermal expansion of the first protrusion 211 and the thermal deformation of the first fixing recess 113 in a state in which the first protrusion 211 is engaged with the first fixing recess 113.

Since the combustor 10 operates in a high-temperature environment, the metal components typically undergo thermal expansion.

When the width D3 of the first protrusion and the width D2 of the first fixing recess 113 are equal to each other or have only a difference smaller than a required value to accommodate a thermal expansion range of the combustor's components, in a case where thermal expansion occurs in a high-temperature operating environment, the contact point of the first protrusion 211 in the first fixing recess 113 undergoes thermal deformation. This may result in thermal damage to components of the combustor 10, leading to deterioration in the functional performance and the life of the combustor 10.

Therefore, the width D3 of the first protrusion 211 and the width D2 of the first fixing recess 113 should be designed taking into consideration the thermal expansion ranges of the metal materials in an anticipated high-temperature operating environment of the combustor 10. The values of the width D3 and the width D2 can be determined experimentally according to the composition of the material of metallic components of the combustor, the operating temperature of the combustor, and the like.

Next, the circumference of the first protrusion 211 may be rounded so that the first protrusion 211 can be smoothly moved through the first guide hole 111. With the first protrusion 211 having a rounded circumference, it is possible to minimize frictional interference when the first protrusion 211 moves through the linear recess 112 of the first guide hole 111. This facilitates engagement between the first protrusion 211 and the first guide hole 111.

The first protrusions 211 are arranged at predetermined intervals along the inner circumference of the outer cap 200. The first guide holes 111 are arranged along the outer circumference of the nozzle plate 100 at positions corresponding to the first protrusions 211. Since multiple first protrusions 211 and multiple first guide holes 111 are provided, the coupling force between the nozzle plate 100 and the outer cap 200 is sufficient.

Second Embodiment

FIGS. 5A and 5B illustrate a coupling structure for coupling a nozzle plate 100 and an outer cap 200 of a combustor 10 according to a second embodiment of the present disclosure, with FIG. 5B showing the coupled state of FIG. 5A.

Referring to FIGS. 5A and 5B, the combustor 10 according to the second embodiment of the present disclosure includes the nozzle plate 100, the outer cap 200, second protrusions 121, and second guide holes 221.

The nozzle plate 100 is a component of the combustor 10 and is made from a heat-resistant metal. As in the first embodiment, the nozzle plate 100 accommodates a plurality of nozzle fitting holes 100*a* (FIG. 4A) in which fuel injection nozzles 18 (FIG. 3) are respectively received to inject fuel into the combustion chamber.

The outer cap 200 has a predetermined diameter to surround, and fit tightly with respect to, the outer circumferential surface of the nozzle plate 100. The outer cap 200 is a combustor component made from a heat-resistant metal and is coupled with the nozzle plate 100. In the coupled state, the outer cap 200 surrounds the fuel injection nozzles 18 mounted in the nozzle plate 100.

The second protrusions 121 are radially arranged along the outer circumference of the nozzle plate 100 at predetermined intervals. Each of the second protrusions 121 protrudes in a radial direction of the nozzle plate 100.

The second guide holes 221 are formed so as to engage with the respective second protrusions 121 and are radially arranged at predetermined intervals along the circumference of the outer cap 200.

Each of the second guide holes 221 includes a continuous formation of a linear recess 222, a first recess curve 223, a second recess curve 224, and a second fixing recess 225, which are sequentially arranged in this order and communicate with each other.

The linear recess 222 extends, from an axial end of the outer cap 200, in a first direction Z in which the nozzle plate 100 is inserted into the inside of the outer cap 200 when the nozzle plate 100 is coupled with the outer cap 200. The linear recesses 222 have a positioning function when the nozzle plate 100 is inserted into the inside of the outer cap 220 to facilitate stable coupling between the nozzle plate 100 and the outer cap 200.

Each of the linear holes 222 has a width E1 that is smaller than or equal to (i.e., not larger than) a width E3 of a corresponding second protrusion 121 so that the second protrusion 121 can be press-fitted into and press-moved through the linear recess 222 when the second protrusion 121 is engaged with the second guide hole 221. After the second protrusion 121 is inserted into the second fixing recess 225, the nozzle plate 100 is not easily separated from the outer cap 200. This is a press-fitted coupling manner. However, the present disclosure is not limited to this press-fitted coupling.

The first recess curve 223 extending from an end of the linear recess 222 is concave-curved in a downward direction (−Z) of the first direction Z, thereby preventing the second protrusion 121 inserted into the linear recess 222 from escaping from the second guide hole 221.

Here, the width E1 of the first recess curve 223 is smaller than or equal to (i.e., not larger than) the width E3 of the second protrusion E3 so that the second protrusion 121 can be press-fitted into and press-moved through the first recess curve 223. The effect of the dimensions of the design of the first recess curve 223 is the same as the linear recess 222.

The second recess curve 224 is concave-curved in an upward direction (+Z) of the first direction Z to prevent the second protrusion 121 passing through the first recess curve 223 from escaping.

Here, the second recess curve 224 has the width E1 smaller than or equal to (i.e., not larger than) the width E3 of the second protrusion 121 so that the second protrusion 121 can be press-fitted into and press-moved through the second recess curve 224. The effect of the dimensions of the design of the second recess curve 224 is the same as the linear recess 222.

The second fixing recess 225 is provided at a distal end of the second recess curve 224. The second protrusion 121 first enters the linear recess 222, then moves all the way through the linear recess 222, the first recess curve 223, and the second recess curve 224, and finally reaches and stays in the second fixing recess 225, at a distance H from the axial end of the outer cap 200.

The second fixing recess 225 has a width E2 larger than the width E3 of the second protrusion 121 so as to secure room to accommodate the thermal expansion of the second protrusion 121 and the thermal deformation of the second fixing recess 225 in a state in which the second protrusion 121 is engaged with the second fixing recess 225.

Since the combustor 10 operates in a high-temperature environment, the metal components typically undergo thermal expansion.

When the width E3 of the second protrusions 121 and the width E2 of the second fixing recess 225 are equal to each other or only have a difference smaller than a required value to accommodate a thermal expansion range of the combustor's components, in a case where thermal expansion occurs in a high-temperature operating environment, the contact point of the second protrusion 121 in the second fixing recess 225 undergoes thermal deformation. This may result in thermal damage to components of the combustor 10, leading to deterioration in the functional performance and the life of the combustor 10.

Therefore, as mentioned above, the width E3 of the second protrusion 121 and the width E2 of the second fixing recess 225 have to be designed while taking into consideration the thermal expansion range of the metallic components of the combustor 10 in a high-temperature operating environment. The values of the width E3 and the width E2 can be determined experimentally according to the composition of the material of metallic components of the combustor, the operating temperature of the combustor, and the like.

Next, the circumferential surface of the second protrusion 121 is rounded so that the second protrusion 121 can smoothly move through the second guide hole 221. With the second protrusion 121 having a rounded circumference, it is possible to minimize frictional interference when the second protrusion 121 moves through the linear recess 222 of the second guide hole 221. This facilitates engagement between the second protrusion 121 and the second guide hole 221.

The second protrusions 121 are arranged at predetermined intervals along the inner circumference of the outer cap 200, and the second guide holes 221 are arranged along the outer circumference of the nozzle plate 100 at positions corresponding to the second protrusions 121. Since multiple second protrusions 121 and multiple second guide holes 221 are provided, the coupling force between the nozzle plate 100 and the outer cap 200 is sufficient.

Third Embodiment

FIGS. 6A and 6B illustrate a coupling structure for coupling a nozzle plate 100 and an outer cap 200 of a combustor 10 according to a third embodiment of the present disclosure, with FIG. 6B showing the couple state of FIG. 6A.

Referring to FIGS. 6A and 6B, the combustor 10 according to the third embodiment of the present disclosure includes the nozzle plate 100, the outer cap 200, second protrusions 121, and second guide holes 231.

The nozzle plate 100 is a component of the combustor 10 and is made from a heat-resistant metal. As in the first embodiment, the nozzle plate 100 accommodates a plurality of nozzle fitting holes 100*a* (FIG. 4A) in which fuel injection nozzles 18 (FIG. 3) are respectively received to inject fuel into the combustion chamber.

The outer cap 200 has a predetermined diameter to surround, and fit tightly with respect to, the outer circumferential surface of the nozzle plate 100. The outer cap 200 is a combustor component made from a heat-resistant metal and is coupled with the nozzle plate 100. In the coupled state, the outer cap 200 surrounds the fuel injection nozzles 18 mounted in the nozzle plate 100.

The second protrusions 121 are radially arranged along the outer circumference of the nozzle plate 100 at predetermined intervals. Each of the second protrusions 121 protrudes in a radial direction of the nozzle plate 100.

The second guide holes 231 are formed so as to be engaged with the respective second protrusions 121 and are radially arranged at predetermined intervals along the circumference of the outer cap 200.

Each of the second guide holes 231 includes a continuous formation of a first linear recess 232, a second linear recess 233, a first recess stop 234, a second recess stop 235, a third linear recess 236, and a second fixing recess 237, which are sequentially arranged in this order and communicate with each other.

The first linear hole 232 extends, from an axial end of the outer cap 200, in a first direction Z in which the nozzle plate 100 is inserted into the inside of the outer cap 200. The second linear hole 233 extends from an end of the first linear hole 232 in a circumferential direction (hereinafter also referred to as a second direction) X of the outer cap 200.

The first and second linear recesses 232 and 233 have a positioning function when the nozzle plate 100 is inserted into the inside of the outer cap 200, thereby facilitating stable coupling between the nozzle plate 100 and the outer cap 200.

The first and second linear recesses 232 and 233 each have a width G1 smaller than or equal to (i.e., not larger than) a width G3 of the second protrusion 121 so that the second protrusion 121 can be press-fitted into and press-moved through the first and second linear recesses 232 and 233 when the second protrusion 121 is engaged with the second guide hole 231. After the second protrusion 121 is inserted into the second fixing recess 237, the nozzle plate 100 is not easily separated from the outer cap 200. This is a press-fitted coupling manner. However, the present disclosure is not limited to this press-fitted coupling.

The first recess stop 234 extends from an end of the second linear recess 233 and is concave-curved in a downward direction (−Z) of the first direction Z to prevent the second protrusion 121 inserted into the second linear recess 233 from escaping.

The first recess stop 234 has the width G1 smaller than or equal to (i.e., not larger than) the width G3 of the second protrusion 121 so that the second protrusion 121 can be press-fitted into and press-moved through the first recess stop 234. The effect of the dimensions of the design is the same as the first and second linear recesses 232 and 233.

The second recess stop 235 extends from an end of the first recess stop 234 and is concave-curved in an upward direction (+Z) of the first direction Z to prevent the second protrusion 121 inserted into the first stopper portion 233 from escaping.

Here, the second recess stop 235 has the width G1 smaller than or equal to (i.e., not larger than) the width G3 of the second protrusion 121 so that the second protrusion 121 can be press-fitted into and press-moved through the second recess stop 235. The effect of the dimensions of the design is the same as the first and second linear recesses 232 and 233. The third linear recess 236 extends from an end of the second recess stop 235 in the circumferential direction (i.e., the second direction) X of the outer cap 200.

The third linear recess 236 impedes the escaping of the second protrusion 121 from the second guide hole 231 by forcing the second protrusion 121 to move only in the second direction Z so as not to move outward through the second recess stop 235 in the event that the second protrusion 121 escapers from the second fixing recess 237. With the structure that moves the nozzle plate 100 only in the second direction X, it is possible to prevent the nozzle plate 100 from moving along a step-shaped path.

The second fixing recess 237 is provided at an end of the third linear recess 236. The second protrusion 121 passes through the third linear recess 236 and reaches and stays in the second fixing recess 237.

The second fixing recess 237 has a width G2 larger than the width G3 of the second protrusion 121 so as to secure room to accommodate the thermal expansion of the second protrusion 121 and the thermal deformation of the second fixing recess 237 in a state in which the second protrusion 121 is engaged with the second fixing recess 237.

Since the combustor 10 operates in a high-temperature environment, the metal components typically undergo thermal expansion.

When the width E3 of the second protrusions 121 and the width E2 of the second fixing recess 237 are equal to each other or only have a difference smaller than a required value to accommodate a thermal expansion range of the combustor's components, in a case where thermal expansion occurs in a high-temperature operating environment, the contact point of the second protrusion 121 in the second fixing recess 237 undergoes thermal deformation. This may result in thermal damage to components of the combustor 10, leading to deterioration in the functional performance and the life of the combustor 10.

Therefore, as mentioned above, the width G3 of the second protrusion 121 and the width G2 of the second fixing recess 237 have to be designed while taking into consideration the thermal expansion range of the metallic components of the combustor 10 in a high-temperature operating environment. The values of the width E3 and the width E2 can be determined experimentally according to the composition of the material of the metallic components of the combustor, the operating temperature of the combustor, and the like.

Next, the circumferential surface of the second protrusion 121 is rounded so that the second protrusion 121 can smoothly move through the second guide hole 231. With the second protrusion 121 having a rounded circumference, it is possible to minimize frictional interference when the second protrusion 121 moves through the linear recesses of the second guide hole 231. This facilitate engagement between the second protrusion 121 and the second guide hole 231.

The second protrusions 121 are arranged at predetermined intervals along the inner circumference of the outer cap 200, and the second guide holes 231 are arranged along the outer circumference of the nozzle plate 100 at positions corresponding to the second protrusions 121. Since multiple second protrusions 121 and multiple second guide holes 231 are provided, the coupling force between the nozzle plate 100 and the outer cap 200 is sufficient.

Meanwhile, referring to FIG. 2, a gas turbine 1 according to another aspect of the present disclosure includes: a casing 2; a compressor section 4 disposed inside the casing 2 and configured to compress air externally introduced to produce compressed air; a combustor 10 disposed inside the casing 2, arranged to be connected to the compressor section 4, functioning to burn the compressed air to produce a combustion gas, and configured to include a coupling structure for coupling a nozzle plate 100 and an outer cap 200; a turbine section 6 disposed inside the casing 10, arranged to be connected to the combustor 10, and functioning to generate electric power using the combustion gas; and a diffuser 7 disposed inside the casing 2, arranged to be connected to the turbine section, and functioning to discharge the air out of the turbine section.

The above description presents merely exemplary embodiments of a combustor and a gas turbine including the same.

As exemplary embodiments of the present disclosure have been described for illustrative purposes, it will be appreciated by those skilled in the art that the embodiments of the present disclosure described above are merely illustrative and that various modifications and equivalent embodiments are possible without departing from the scope and spirit of the claimed invention. Specific terms used in this disclosure and drawings are used for illustrative purposes and not to be considered as limitations of the present disclosure. Therefore, it will be appreciated that the present disclosure is not limited to the form set forth in the foregoing description. Accordingly, the scope of technical protection of the claimed invention is determined by the technical idea of the appended claims. One of ordinary skill would understand that the present disclosure covers all modifications, equivalents, and alternatives falling within the spirit and the scope of the claimed invention as defined by the appended claims.

What is claimed is:

1. A combustor of a gas turbine, the combustor comprising:

a nozzle plate formed to accommodate an arrangement of fuel injection nozzles, the nozzle plate including a disc and an annular wall extending perpendicularly from an outer circumferential periphery of the disc in a first direction toward an interior space of the combustor for receiving the fuel injection nozzles;

an outer cap that has an annular shape formed to surround the nozzle plate, the outer cap configured to be coupled with the nozzle plate by inserting the nozzle plate into the outer cap in the first direction;

a plurality of protrusions radially protruding outward from the annular wall of the nozzle plate, the plurality of protrusions distributed along a circumferential direction of the nozzle plate and disposed a predetermined distance from an axial end of the annular wall of the nozzle plate; and a plurality of guide holes formed radially through a circumferential periphery of the outer cap and distributed along a circumferential direction of the outer cap, the plurality of guide holes configured to be respectively engaged with the plurality of protrusions when the nozzle plate is coupled to the outer cap, wherein each guide hole of the plurality of guide holes includes a linear recess extending from an axial end of the outer cap in the first direction, and wherein the linear recess of each guide hole of the plurality of guide holes has a width that is not larger than a width of a corresponding protrusion of the plurality of protrusions, the width of the linear recess enabling the corresponding protrusion to be press-fitted into and press-moved through the linear recess.

2. A combustor of a gas turbine, the combustor comprising:

a nozzle plate formed to accommodate an arrangement of fuel injection nozzles, the nozzle plate including a disc and an annular wall extending perpendicularly from an outer circumferential periphery of the disc in a first direction toward an interior space of the combustor for receiving the fuel injection nozzles;

an outer cap that has an annular shape formed to surround the nozzle plate, the outer cap configured to be coupled with the nozzle plate by inserting the nozzle plate into the outer cap in the first direction;

a plurality of protrusions radially protruding outward from the annular wall of the nozzle plate, the plurality of protrusions distributed along a circumferential direction of the nozzle plate and disposed a predetermined distance from an axial end of the annular wall of the nozzle plate; and a plurality of guide holes formed radially through a circumferential periphery of the outer cap and distributed along a circumferential direction of the outer cap, the plurality of guide holes configured to be respectively engaged with the plurality of protrusions when the nozzle plate is coupled to the outer cap, wherein each guide hole of the plurality of guide holes includes:

a first linear recess extending from an axial end of the outer cap in the first direction, the first linear recess communicating with the axial end of the outer cap; and a second linear recess extending from an end of the first linear recess in a second direction which is the circumferential direction of the outer cap, the second linear recess communicating with the end of the first linear recess, wherein the first linear recess of each guide hole of the plurality of guide holes and the second linear recess of each guide hole of the plurality of guide holes each has a width that is not larger than a width of a corresponding protrusion of the plurality of protrusions, the widths of the first linear recess and the second linear recess enabling the corresponding protrusion to be press-fitted into and press-moved through the first linear recess and the second linear recess.

3. The combustor according to claim 2, wherein the second linear recess of each guide hole of the plurality of guide holes includes a first recess stop that includes a curve concaved in the first direction perpendicular to the second direction, the curve of the first recess stop configured to prevent the corresponding protrusion passing through the second linear recess from escaping from the second linear recess.

4. The combustor according to claim 3, wherein the second linear recess of each guide hole of the plurality of guide holes further includes a second recess stop that includes a curve concaved in a third direction opposite to the first direction, the curve of the second recess stop configured to prevent the corresponding protrusion passing through the first recess stop from escaping from the first recess stop.

5. The combustor according to claim 4, wherein the first recess stop of each guide hole of the plurality of guide holes and the second recess stop of each guide hole of the plurality of guide holes, each has a width that is not larger than the width of the corresponding protrusion of the plurality of protrusions, the widths of the first recess stop and the second recess stop enabling the corresponding protrusion to be press-fitted into and press-moved through the first recess stop and the second recess stop.

6. The combustor according to claim 3, wherein each guide hole of the plurality of guide holes further includes a third linear recess extending, from an end of the second recess stop, in the second direction.

7. The combustor according to claim 6, wherein each guide hole of the plurality of guide holes further includes a fixing recess disposed at an end of the third linear recess, and wherein the fixing recess has a width larger than the width of the corresponding protrusion of the plurality of protrusion, the width of the fixing recess securing room to accommodate thermal expansion of the corresponding protrusion and thermal deformation of the fixing recess.

* * * * *